US005335914A

United States Patent [19]

Long

[11] Patent Number: 5,335,914

[45] Date of Patent: Aug. 9, 1994

[54] GOLF CLUB HEAD

[75] Inventor: Clay Long, Albany, Ga.

[73] Assignee: ProGroup, Inc., Chattanooga, Tenn.

[21] Appl. No.: 47,262

[22] Filed: Apr. 13, 1993

[51] Int. Cl.[5] ..... A63B 53/04

[52] U.S. Cl. ..... 273/169; 273/167 F; 273/167 H

[58] Field of Search ..... 273/167 R, 167 A, 167 D, 273/167 E, 167 F, 167 G, 167 H, 167 J, 167 K, 169, 170, 171, 172, 173, 174, 164.1, 193 R, 194 R, 194 A, 77 R, 77 A, 162 R; D21/214, 220

[56] References Cited

U.S. PATENT DOCUMENTS

| | | | |
|---|---|---|---|
| D. 191,211 | 8/1961 | Forest . | |
| D. 240,948 | 8/1976 | Redoutey . | |
| D 247,383 | 2/1978 | Adkins . | |
| D. 247,918 | 5/1978 | Delano et al. . | |
| D. 254,084 | 1/1980 | Hulyk . | |
| D. 259,732 | 6/1981 | Vella . | |
| D. 302,715 | 8/1989 | Petersen . | |
| D. 316,584 | 4/1991 | Antonious . | |
| 1,139,985 | 5/1915 | Legh . | |
| 1,258,212 | 3/1918 | Goodrich . | |
| 1,525,148 | 2/1925 | Pickop . | |
| 1,652,404 | 12/1927 | Graveure | 273/169 X |
| 1,671,956 | 5/1928 | Sime | 273/167 F X |
| 1,917,774 | 7/1933 | Ogg | 273/167 F |
| 1,993,928 | 3/1934 | Glover . | |
| 2,608,409 | 8/1952 | Pinkerton . | |
| 2,686,056 | 8/1954 | Oquist . | |
| 3,037,770 | 6/1962 | Palmer | 273/80 C |
| 3,059,926 | 10/1962 | Johnstone . | |
| 3,064,980 | 11/1962 | Steiner . | |
| 3,343,839 | 9/1967 | Borah | 273/171 X |
| 3,429,576 | 2/1969 | Ikeda . | |
| 3,497,220 | 2/1970 | Scott . | |
| 3,595,577 | 7/1971 | Hodge | 273/167 E X |
| 3,625,513 | 12/1971 | Ballmer . | |
| 3,814,437 | 6/1974 | Winquist | 273/167 R |
| 3,841,641 | 10/1974 | Bennett | 273/80 C X |
| 3,845,955 | 11/1974 | Solheim | 273/162 R X |
| 3,941,390 | 3/1976 | Hussey . | |
| 3,955,820 | 5/1976 | Cochran et al. . | |
| 3,966,210 | 10/1976 | Rozmus . | |
| 3,995,857 | 12/1976 | Cochran et al. . | |
| 3,995,865 | 12/1976 | Cochran et al. . | |
| 4,214,754 | 7/1980 | Zebelean . | |
| 4,220,336 | 9/1980 | Kochevar . | |
| 4,265,451 | 5/1981 | Bernhardt . | |
| 4,265,452 | 5/1981 | Vella . | |
| 4,419,275 | 12/1986 | Winkleman | 273/171 |
| 4,580,784 | 4/1986 | Brill . | |
| 4,607,846 | 8/1986 | Perkins . | |

(List continued on next page.)

FOREIGN PATENT DOCUMENTS

| | | |
|---|---|---|
| 558183 | 1/1975 | Switzerland . |
| 29603 | | United Kingdom . |
| 359487 | 10/1931 | United Kingdom . |
| 1232651 | 5/1971 | United Kingdom . |
| 1297239 | 11/1972 | United Kingdom . |
| 2133295 | 7/1984 | United Kingdom . |
| 2170719 | 8/1986 | United Kingdom . |

*Primary Examiner*—Vincent Millin
*Assistant Examiner*—Sebastiano Passaniti
*Attorney, Agent, or Firm*—Wood, Herron & Evans

[57] ABSTRACT

A golf club having weight members located at the toe and the hosel of a cavity back club head. The toe weight and hosel weight each have a center of mass which is located above a horizontal line drawn through the center of gravity of the club head when the club head is lying at address. In one preferred embodiment the toe weight extends rearwardly from the toe rim of the club head and rearward of a plane containing the rear edges of the club head to increase the back weighting and therefore the dynamic loft of the club head. The hosel weight extends outwardly from the hosel and is located anywhere within a 90° segment of the outer periphery of the hosel. At one extreme position, the hosel weight extends outwardly in a plane which is generally parallel to the leading edge of the club head and at another extreme position the hosel weight extends rearwardly and generally at right angles to the leading edge of the club head.

33 Claims, 2 Drawing Sheets

U.S. PATENT DOCUMENTS 4,621,813 11/1986 Solheim .
4,650,191 3/1987 Mills .
4,747,599 5/1988 Antonious .
4,754,977 7/1988 Sahm .
4,826,172 5/1989 Antonious .
4,852,879 8/1989 Collins .
4,867,458 9/1989 Sumikawa et al. .
4,915,386 4/1990 Antonious .
4,938,470 7/1990 Antonious .
4,948,140 8/1990 Antonious .
4,999,000 3/1991 Finney ..... 273/167 F
5,004,237 4/1991 Antonious .
5,011,151 4/1991 Antonious .
5,046,733 9/1991 Antonious .
5,078,400 1/1992 Desbiolles et al. .
5,193,805 3/1993 Solheim ..... 273/167 F X

GOLF CLUB HEAD

BACKGROUND OF THE INVENTION

This invention generally relates to golf clubs and more particularly to golf club heads having weight distributions which increase important moments of inertia of the club head while also increasing the "dynamic loft" of the club head.

Club heads employing various types of perimeter weighting have become quite common in the art, especially iron club heads or "irons" having so-called "cavity back" designs. In these club heads weight is in effect removed from the center of the club head and redistributed along the bottom of the club head, for example, or along the heel and toe portions of the club head, or around the entire periphery of the club head to produce a club head having a recess or cavity in the back. Club heads of the latter type have enjoyed considerable success since they effectively enlarge the "sweetspot" of the club head.

The "sweetspot" of the club head is generally regarded to be that area on the striking face of the club head immediately surrounding the center of gravity of the club head. By enlarging the sweetspot, perimeter weighted club heads allow golfers of all abilities to realize improved results over conventional club heads when the golfer fails to strike the golf ball in line with the center of gravity of the club head. These improved results translate into mis-hit shots that travel farther and straighter than they would if struck with a club having another conventional club head design.

Club heads are also known which include heel/toe weighting or hosel/toe weighting for reasons of improving the control of the club head during the swing and particularly at impact to produce shots which have less of a tendency to "hook" or "slice". The use of heel/toe or hosel/toe weighting on a club head increases the moment of inertia about a vertical axis through the center of gravity of the club head so that the club head is more stable when in a less than ideal orientation or position at impact. Examples of club heads employing heel/toe or hosel/toe weighting are found in U.S. Pat. Nos. 3,995,865 to Cochran et al., 4,826,172 to Antonious, and 5,078,400 to Desbiolles et al., and in UK Patent Application No. 2,170,719 to Kajita et al.

Cochran et al. disclose an iron club head having weight members embedded in the rear surface of the club head at the toe and heel portions thereof to increase the "radius of gyration" of the club head. Cochran et al. teach that the mass of the toe weight should be two to three times as great as the mass of the heel weight. Also, the weights are shown to be located on a line which angles upwardly from the center of the heel weight to the center of the toe weight and which extends through the center of mass of the club head located between the heel and toe weights.

Antonious discloses a "cavity back" iron club head having additional weight members contained in the cavity in various configurations. Some of the additional weight members, as disclosed in the embodiments of the Antonious patent, are generally located in the heel and toe portions of the club head and are said to maximize energy transfer for off-center shots and stabilize the club to provide better control with minimum loss of distance. Similar to the disclosure of Cochran et al., Antonious shows such heel and toe weights located on a line extending upwardly from the heel weight to the toe weight and passing through the "center of percussion" of the club head.

Desbiolles et al. disclose club heads having weight members placed in a lower portion of the toe and on the hosel of the club head. Alternative embodiments of the invention are disclosed with one alternative contemplating a nonuniform horizontal weight distribution having peaks in the weight distribution at the toe and, to a lesser extent, at the hosel area of the club head. In the other alternative embodiment the horizontal weight distribution is relatively uniform, however, toe and hosel weights are added to the club head to contribute to the uniform weight distribution.

UK Patent Application No. 2,170,719 to Kajita et al. shows a "wood" type club head in FIGS. 9 and 10 in which weight has been added in the hosel portion, rear portion and toe portion of the club head by "thickening" these portions of the club head. However, Kajita et al. fail to disclose the specific relationship between the centers of mass of the hosel and toe weights and the center of gravity of the club head.

Many efforts have also been made to produce a club head that aids a golfer, using a golf club with a striking face of a given loft angle, in hitting higher trajectory shots. The most common approaches have relied solely on the principle of offsetting the club head behind the shaft of the club. This can effectively produce a rearward placement of the club head's center of gravity with respect to the club's shaft and thereby cause the lowermost end of the shaft to bend more in the forward direction during the swing to increase the loft angle of the striking face of the club head at impact (that is, to increase the "dynamic loft" of the club head). One problem associated with golf clubs having offset club heads relates to the non-traditional appearance of the club head. Many golfers refuse to play with such clubs because they find the offset club head visually disruptive when addressing the ball.

Although prior golf clubs have had some success with increasing the moment of inertia about a vertical axis through the center of gravity of the club head, they have faltered in maximizing the moment of inertia about a horizontal axis through the center of gravity of the club head. These clubs have also failed to maximize both of the moments of inertia mentioned above while also effectively "backweighting" the club head, i.e., shifting weight and, likewise, the center of gravity of the club head behind the centerline of the club shaft, so as to increase the dynamic loft of the club to produce higher trajectory shots with club heads having striking faces of a given loft angle. Finally, past golf clubs have failed to significantly increase the dynamic loft of the club head while maintaining a more traditional looking club head without an extreme offset.

Accordingly, one object of the present invention has been to effect a weight distribution for a club head which significantly increases the moments of inertia about both horizontal and vertical axes through the club head center of gravity to more completely stabilize the club head at impact during mis-hit shots.

Another object of the invention has been to effectively backweight a golf club head to increase the dynamic loft of the club head at impact and produce higher trajectory shots than were heretofore possible with club heads having striking faces of a given loft angle.

Still another object of the invention has been to increase club head speed for such a backweighted club head by achieving a low aerodynamic drag through the highest portions of the club head's velocity before impact.

SUMMARY OF THE INVENTION

To these ends, a preferred embodiment of the present invention contemplates the placement of weight members at the toe and hosel portions of a golf club head. More specifically, the toe weight is located on the rear, outer rim of the club head at the toe portion of, for example, a "cavity back iron" type club head. The hosel weight is preferably affixed to the hosel such that it extends outwardly from the hosel in a direction generally parallel to the leading edge of the striking face and preferably increases in thickness from a lower portion of the hosel weight to an upper portion of the hosel weight.

In one aspect of the present invention the toe and hosel weight members each have a center of mass which is located above a horizontal axis drawn through the center of gravity of the club head when the club head is lying at address, i.e., when the sole of the club head is essentially lying flat on the ground. This arrangement of the toe and hosel weights increases the moment of inertia about a horizontal axis passing through the center of gravity of the club head. Conventional irons, for example, have a weight distribution which places a majority of the club head mass at or near the sole of the club head. Thus, by adding weight above the horizontal axis drawn through the center of gravity as described above, the moment of inertia about that axis is increased. Increasing this moment of inertia stabilizes the club head at impact and increases energy transfer between the golf ball and the club face when the golf ball impacts the club face above or below the center of gravity of the club head.

In another aspect of the invention the toe weight is placed on the rim which surrounds the rear cavity of a "cavity back iron" club head. The toe weight preferably extends rearwardly of a plane containing the rear edges of the rim surrounding the cavity. This design significantly backweights the club head so as to increase the dynamic loft of the club head at impact while maintaining a more traditional club head appearance.

In other aspects of the invention the hosel weight may be affixed within approximately a 90° segment of the circumference of the hosel between a position in which it extends in a plane generally parallel to the leading edge of the club head and a position in which it extends rearwardly generally at right angles to the leading edge of the club head. The repositioning of the hosel weight to the latter position allows the moment of inertia about a vertical axis passing through the center of gravity of the club head to be increased relative to a conventional club head while also contributing to the backweighting of the club head to increase the dynamic loft of the club head at impact.

In an alternative embodiment weight members are placed at the toe and hosel portions of a "wood" type club head in a manner and location similar to the weight members used on the "iron" type club head of the invention as described above. As is well known in the art "wood" type club heads may, for example, be formed of metal, graphite composites, polymeric material, or wood. The advantages and results achieved by placing such toe and hosel weight members on a "wood" type club member are generally the same as those described above in connection with the "iron" type club head of the present invention.

Further objects and advantages will become apparent to those of ordinary skill in the art from the following detailed description taken in conjunction with the accompanying drawings.

DETAILED DESCRIPTION OF THE PREFERRED EMBODIMENTS

Figure 1:
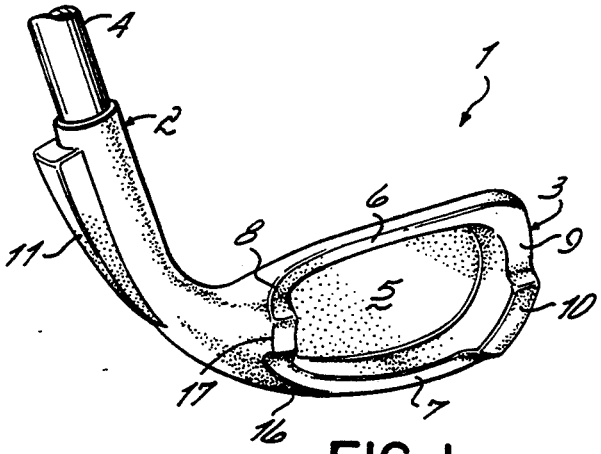
FIG. 1 is a rear perspective view of a cavity back iron embodying the present invention.

Referring first to FIG. 1, an "iron" type club head 1 includes a hosel 2 and a toe 3. A golf club shaft 4 is attached to and extends upwardly from the hosel 2. The preferred club head 1 is of the "perimeter weighted" variety in which a cavity 5 is created in the rear of the club head 1, and is surrounded by a top rim 6, a bottom rim 7, a heel rim 8 and a toe rim 9. A toe weight or first weight 10 extends rearwardly from the toe rim 9 and a hosel weight or second weight 11 preferably extends outwardly from the hosel 2 in a plane which is generally parallel to the leading edge 15 of the club head 1 (see FIG. 4). Optionally, and for additional backweighting of the club head 1, the club head 1 may include a heel weight 17 which extends rearwardly from the heel rim 8 at the rear of the club head 1.

As one typical example of an "iron" club head formed according to the principles of the invention and having a total mass of 253 grams, the toe weight 10 has a mass of approximately 3.7 grams, the hosel weight has a mass of approximately 7.5 grams, and the heel weight 17 has a mass of approximately 2.2 grams. The toe weight 10 is preferably an integral part of the toe 3 of the club head 1 and, in the preferred embodiment, is a projecting mass of material which extends rearwardly from the surface of the toe rim 9. In the preferred embodiment the hosel weight 11 is also integrally formed on the outside surface of the hosel 2 and extends outwardly therefrom.

Figure 2:
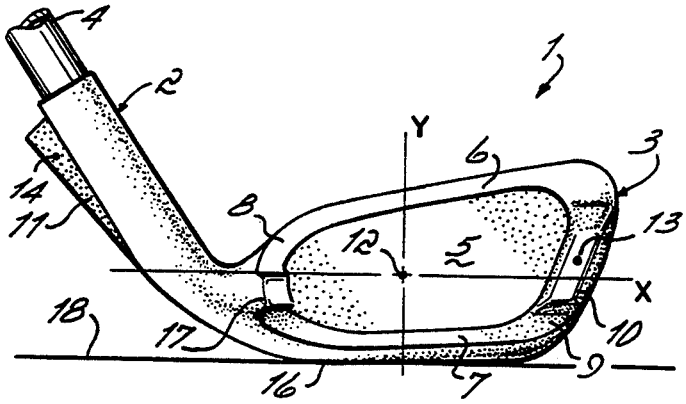
FIG. 2 is a rear elevational view of the cavity back iron of FIG. 1 shown at address resting on a support surface and comparing the relative locations of the centers of mass of both the toe and hosel weight members with the center of gravity of the club head and showing the preferred location and shape of the hosel weight.

As shown in FIG. 2, the club head 1 has a center of gravity 12 which, taking into account the effect of the toe weight 10, hosel weight 11 and heel weight 17, is preferably located approximately 0.890 inches above the sole 16 of the club head 1. The toe weight 10 has a center of mass 13 and the hosel weight 11 has a center of mass 14. These centers of mass 13, 14 are each located above a horizontal axis "x" extending through the center of gravity 12 of the club head 1 and generally parallel to a support surface 18 such as the ground on which the club head 1 rests at address. By placing the weight members 10, 11 above the center of gravity 12 club head weight is effectively being redistributed from the sole or bottom area of the club head 1 to the top of the club head 1. Redistributing club head weight in this manner advantageously increases the moment of inertia about the horizontal axis "x".

The specific locations shown in FIG. 2 for the toe weight 10 and the hosel weight 11 help to maximize the moments of inertia about both a horizontal axis "x" and a vertical axis "y" extending through the center of gravity 12 of the club head 1. This configuration of the toe weight 10 and hosel weight 11 effectively stabilizes the club head 1 at impact during mis-hit shots when the golf ball strikes the club head 1 either above or below the horizontal axis "x" or on either side of the vertical axis "y".

As further shown in FIG. 2, the hosel weight 11 tapers in thickness such that its thickness in a plane perpendicular to the hosel 2 increases upwardly along the hosel 2. This concentrates the added weight in an upper portion of the hosel 2 so as to further increase the moment of inertia of the club head 1 about the horizontal axis "x". Also, when the hosel weight 11 is used in the alternative location (shown in FIG. 4) in which it extends rearwardly generally at right angles to the lower leading edge 15 of the club head 1, the tapered shape and rearward position tend to reduce the aerodynamic drag of the club head during the swing resulting in higher club head speed at impact.

Figure 3:
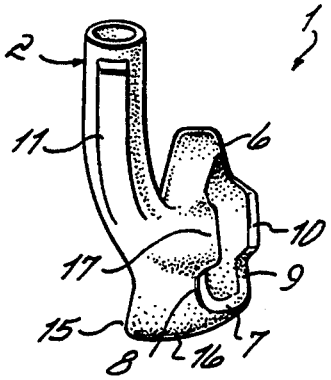
FIG. 3 is a side elevational view of the club head of FIG. 1 showing the position of the toe weight and heel weight with respect to the rear edges of the club head.

Turning now to FIG. 3, the toe weight 10 extends rearwardly from the toe rim 9 such that it extends rearwardly of a plane containing the top rim 6, bottom rim 7, heel rim 8 and toe rim 9. In a like manner, the optional heel weight extends rearwardly of the plane containing the top rim 6, bottom rim 7, heel rim 8 and toe rim 9. The extreme rearward extension of both the toe weight 10 and heel weight 17 significantly backweights the club head 1 thereby increasing the dynamic loft of the club head 1 without resorting to a club head design having an extreme offset. That is, since this additional weight is concentrated entirely behind the usual rearmost edges 6, 7, 8, 9 of the club head 1, the center of gravity 12 of the club head 1 is shifted significantly in a rearward direction with respect to the shaft 4 of the club and this causes the lowermost end of the shaft 4 to bend more in the forward direction during the portion of the swing just prior to impact thereby increasing the loft angle of the striking face of the club head 1 at impact. This results in higher trajectory shots from clubs having striking faces of a given loft angle. The effects of backweighting the club head are described in more detail below with reference to FIGS. 6A–6C.

Figure 4:
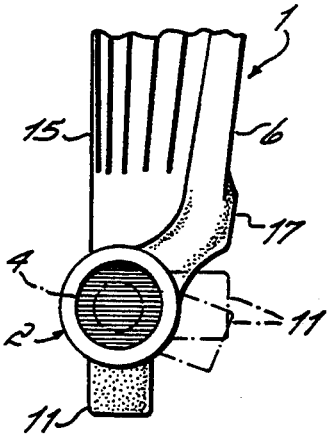
FIG. 4 is a partially fragmented top view of the heel and hosel portion of the club head showing, partly in phantom, the angular segment of the hosel on which the hosel weight may be located.

Turning now to FIG. 4, the hosel weight 11 is shown in its preferred location, i.e., extending outwardly from the hosel 2 in a plane which is generally parallel to the lower leading edge 15 of the club head 1. As previously mentioned, the positioning of the hosel weight 11 in this manner increases the moment of inertia about a vertical axis "y" extending through the center of gravity 12 of the club head 1 (see FIG. 2). The toe weight 10 and hosel weight 11 together function to increase the moment of inertia about the "y" axis by distributing weight as far from the "y" axis as possible while still maintaining a traditional club head appearance.

As further shown in FIG. 4, the invention contemplates optionally positioning the hosel weight 11 anywhere along approximately a 90° segment (viewed looking downwardly along the shaft 4) of the periphery of the hosel 2. This 90° segment is bounded by extreme locations of the hosel weight 11 in which, at one extreme, the hosel weight 11 extends outwardly from the hosel 2 in a plane generally parallel to the lower leading edge 15 of the club head 1 and, at another extreme, the hosel weight 11 extends rearwardly from the periphery of the hosel 2 in a plane generally at right angles to the lower leading edge 15 of the club head 1. The latter extreme location is shown in FIG. 4 in phantom as is one optional location of the hosel weight 11 and is further shown in FIG. 5 described in more detail below.

The shifting of the hosel weight 11 from a position in which it extends in a plane generally parallel to the lower leading edge 15 of the club head 1 toward a position in which it extends rearwardly in a plane generally at right angles to the lower leading edge 15 of the club head 1 effectively decreases the moment of inertia about the vertical axis "y" extending through the center of gravity 12 (FIG. 2) of the club head 1 and may, depending on the location of the center of gravity of a club head having a striking face of a given loft angle, increase the back weighting and therefore the dynamic loft of the club head 1.

Figure 5:
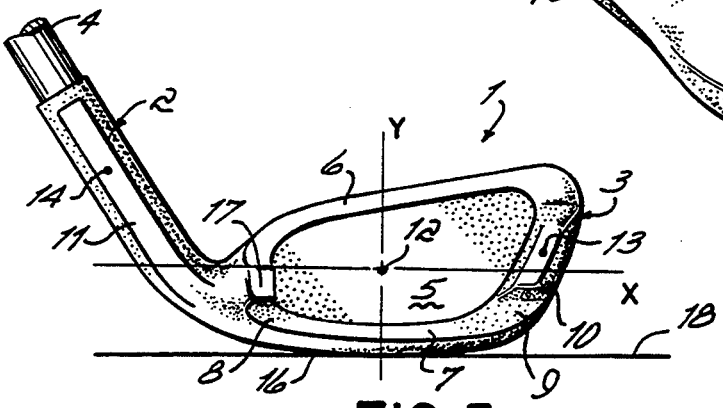
FIG. 5 is a rear elevational view showing the club head at address resting on a support surface but showing the hosel weight in one alternative position extending outwardly from a rear portion of the hosel.

As its club face angle or "loft angle" increases, i.e., as the club head becomes "more lofted", the center of gravity 12 of the club head 1 generally shifts in a rearward direction with respect to the golf club shaft 4. As a result, at a given loft angle the hosel weight 11 (positioned as shown in FIG. 5) will not significantly contribute to the backweighting of the club head 1 and therefore will not significantly increase the dynamic loft of the club head 1. This results from the fact that, at some particular loft angle, the center of mass 14 of the hosel weight 11 will no longer be positioned rearward of the center of gravity 12 of the club head 1. Thus, with club heads of such loft angle or greater it may be more beneficial to extend the hosel weight 11 outwardly from the hosel 2 in a plane generally parallel to the leading edge 15 of the club head 1. This will further increase the moment of inertia of the club head 1 about the vertical axis "y" of the club head 1 while maintaining a high moment of inertia about the horizontal axis "x" of the club head 1.

FIG. 5 shows the hosel weight 11 in an optional position in which it extends rearwardly generally in a plane which is at right angles to the leading edge 15 of the club head 1. This position can significantly increase the overall backweighting of the club head 1 and therefore increase the dynamic loft of the club head 1 to produce higher trajectory golf shots. The club head 1 further includes a heel weight 17 which, when combined with the toe weight 10 and hosel weight 11 as shown in FIG. 5, serves to further increase the back weighting and dynamic loft of the club head 1.

Figure 6A:
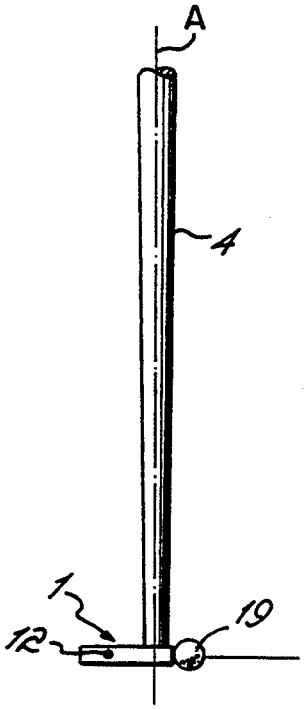
FIGS. 6A–6C are schematic representations of a club showing the lower end of the club shaft and the club head progressively bending farther in a forward direction as the load on the club head increases due to increasing centrifugal forces during the swing; and, FIG. 7 is a perspective view of an alternative embodiment of the invention showing hosel and toe weight members placed on a "wood" type club head according to the invention.
Figure 6B:
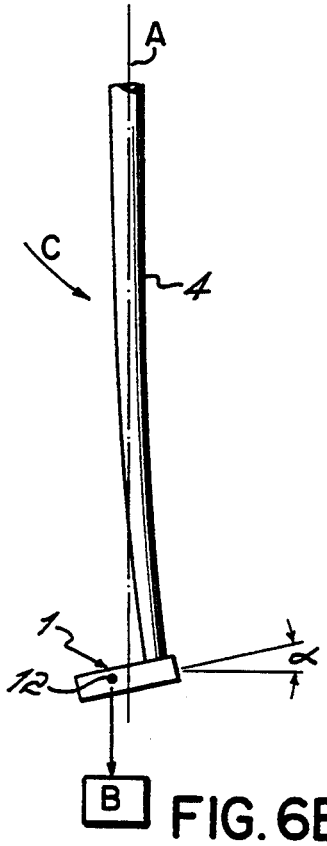
Figure 6C:
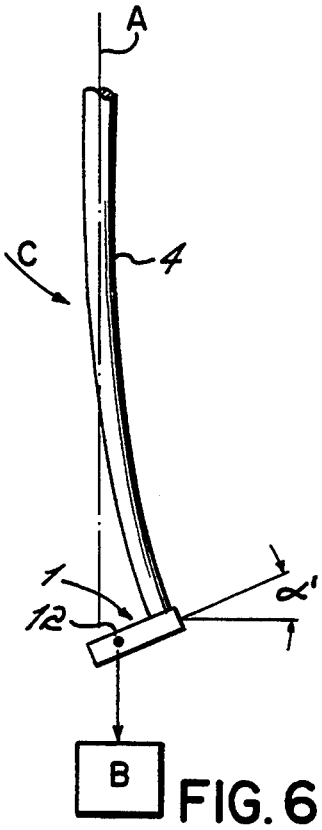

This effect of backweighting the club head 1 is schematically illustrated in FIGS. 6A–6C. FIG. 6A shows the golf club at rest addressing a golf ball 19 without any centrifugal forces acting on the club head 1. As shown in an exaggerated manner in FIG. 6A, backweighting the club head 1 as taught by the present invention places the center of gravity 12 of the club head 1 behind the centerline "A" of the shaft 4.

As shown in FIG. 6B, the centrifugal force "B" created by the rapid circular rotation of the golf club during the downward or counterclockwise portion of the swing, represented by arrow "C", toward a golf ball tends to cause the lower end of the shaft 4 and the club head 1 to flex toward the golf ball, i.e., in a forward direction. This forward bend of the lower end of the shaft 4 causes the loft angle of the club face to increase by an amount $\alpha$.

FIG. 6C shows, in an exaggerated manner, the shaft 4 flexing as the club head speed increases in the direction of the arrow "C". As the club head speed increases, the centrifugal force "B" likewise increases and causes the lower end of the shaft 4 to bend more in the forward direction. As further shown in FIG. 6C, when the speed of the swing increases such that the centrifugal force "B" causes the shaft 4 to bend to the point at which the center of gravity 12 of the club head 1 is in line with the centerline "A" of the shaft 4, the shaft 4 will bend no further. This maximum amount of bending of the lower end of the shaft 4 increases the loft angle of the club head 1 by a corresponding maximum amount $\alpha'$ thereby resulting in higher trajectory shots.

From FIGS. 6A–6C and the above description thereof, it will be appreciated that placement of the center of gravity farther behind the centerline "A" of the shaft 4 causes increased forward bending of the lower end of the shaft 4 during the swing. Of course, the final loft angle of the club head 1 at impact will also depend on the club head speed at impact as well as the location of the "flex point" of the shaft 4, i.e., the point along the shaft 4 at which the most deflection occurs during the golf swing.

Figure 7:
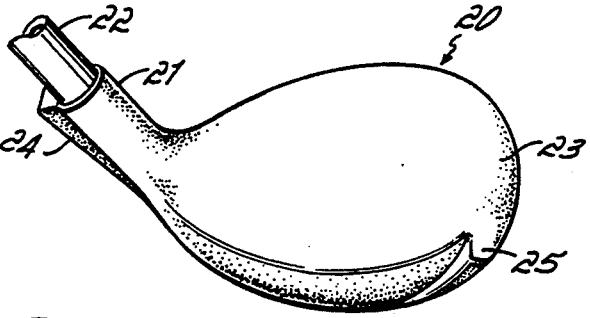

FIG. 7 illustrates an alternative embodiment in which the concepts of the present invention are employed on a "wood" type golf club head 20. As with the first embodiment, the club head 20 includes a hosel 21 adapted to receive a golf club shaft 22 and further includes a toe portion 23. A hosel weight 24 extends outwardly from a portion of the periphery of the hosel 21 and a toe weight 25 extends rearwardly from the toe portion 23 of the club head 20. Although shown in its preferred position extending outwardly in a plane generally parallel to the leading edge (not shown) of the club head 20, the hosel weight 24 may be positioned anywhere along the 90° segment illustrated in FIG. 4. The advantages obtained from shifting the hosel weight 24 from one location to another on the hosel 21 are the same as those expressed above with respect to the "iron" embodiment.

Although not specifically illustrated in FIG. 7 due to the perspective view of the club head 20, the club head 20 includes a center of gravity and the hosel weight 24 and the toe weight 25 each have a center of mass which is located above a horizontal line running through the center of gravity of the club head 20. Thus, the concepts and advantages behind employing the hosel weight 24 and toe weight 25 on the "wood" club head 20 are identical to the concepts and advantages explained above with respect to the "iron" embodiment of the invention.

Accordingly, in each embodiment of the present invention the moments of inertia about both horizontal and vertical axes through the club head center of gravity have been significantly increased so as to more completely stabilize the club head at impact during shots which are hit off line of the center of gravity of the club head. At the same time, the dynamic loft of the club head has been increased to result in higher trajectory shots with club heads having striking faces of a given loft angle. Finally, when the hosel weight is positioned at substantially right angles to the leading edge of the club head, a back weighted club head is produced also having a low aerodynamic drag which can allow increased club head speed as compared to prior clubs.

Although preferred embodiments of the present invention have been described in detail above, certain modifications will become readily apparent to those of ordinary skill in the art without departing from the scope of the invention and applicant intends to be bound only by the scope of the claims appended hereto.

I claim:

1. A golf club head having a toe, a heel, a body extending between said toe and said heel, and a hosel extending upwardly from said heel for receiving a golf club shaft, said club head including a center of gravity located between said toe and said heel, and first and second weight members, said first weight member projecting rearwardly from said toe and said second weight member projecting outwardly from an angular segment of the periphery of said hosel, wherein said angular segment is less than 360° and said first and second weight members each have at least a portion thereof positioned above a horizontal line containing the center of gravity, said horizontal line being generally parallel to a support surface on which said club head rests when said club head is lying at address.

2. The golf club head of claim 1 wherein said angular segment is approximately 90° and wherein, at one extreme thereof, said second weight member projects away from and generally parallel to a lower leading edge of said club head and, at another extreme thereof, said second weight member projects rearwardly and generally at right angles to said lower leading edge of said club head.

3. The golf club head of claim 2 wherein said first and second weight members each have a center of mass and said centers of mass of said first and second weight members are each located above said horizontal line.

4. The golf club head of claim 3 wherein said second weight member projects from said hosel rearwardly and generally at right angles to said lower leading edge.

5. The golf club head of claim 3 wherein said second weight member projects from said hosel away from and generally parallel to said lower leading edge.

6. The golf club head as claimed in claim 4 wherein said second weight member tapers upwardly and outwardly along said hosel.

7. The golf club head as claimed in claim 5 wherein said second weight member tapers upwardly and outwardly along said hosel.

8. The golf club head of claim 1, 6 or 7 wherein a rear face of said club head is a recessed cavity back surrounded by a top rim, bottom rim, toe rim and heel rim and said first weight member projects rearwardly from said toe rim such that said first weight member extends rearwardly of a plane containing said top rim, bottom rim, toe rim and heel rim.

9. The golf club head of claim 8 further comprising a third weight member extending rearwardly from said heel rim.

10. A golf club head having a toe, a heel, a body extending between said toe and said heel, and a hostel extending upwardly from said heel for receiving a golf club shaft, said body having top and bottom surfaces having rear edges, said club head including a center of gravity located between said toe and said heel, and a first weight member projecting rearwardly from said toe and projecting rearwardly of a plane containing said rear edges of said topand bottom surfaces, said first weight member having a center of mass located above a horizontal line containing said center of gravity of said club head, said horizontal line being generally parallel to a support surface on which said club head rests when said club head is lying at address, wherein a rear face of said club head is a recessed cavity back surrounded by a top rim, bottom rim, toe rim and heel rim and said first weight member projects rearwardly from said toe rim.

11. The golf club head of claim 10 further including a second weight member, said second weight member projecting from said hosel within an angular segment of the periphery of said hosel, said angular segment covering approximately 90° and wherein, at one extreme thereof, said second weight member projects away from and generally parallel to a lower leading edge of said club head and, at another extreme thereof, said second weight member projects rearwardly and generally at right angles to said lower leading edge of said club head.

12. The golf club head of claim 11 wherein said second weight member projects from said hosel rearwardly and generally at right angles to said lower leading edge.

13. The golf club head of claim 11 wherein said second weight member projects from said hosel away from and generally parallel to said lower leading edge.

14. The golf club head as claimed in claim 12 wherein said second weight member tapers upwardly and outwardly along said hosel.

15. The golf club head as claimed in claim 13 wherein said second weight member tapers upwardly and outwardly along said hosel.

16. The golf club head of claim 15 further comprising a third weight member extending rearwardly from said heel rim.

17. A golf club head having a toe, a heel, a body extending between said toe and said heel, and a hosel extending upwardly from said heel for receiving a golf club shaft, said body having top and bottom surfaces, said club head including a center of gravity located between said toe and said heel, and first and second weight members on said toe and said hosel, respectively, said first and second weight members each having a center of mass, said centers of mass of said first and second weight members each being located above a horizontal line containing said center of gravity of said club head, said horizontal line being generally parallel to a support surface on which said club head rests when said club head is lying at address.

18. The golf club head of claim 17 wherein said first weight member projects rearwardly of a plane containing rear edges of said top and bottom surfaces and said second weight member projects from an angular segment of the periphery of said hosel, wherein said angular segment is less than 360°.

19. The golf club head of claim 18 wherein said angular segment is approximately 90° and wherein, at one extreme thereof, said second weight member projects away from and generally parallel to a lower leading edge of said club head and, at another extreme thereof, said second weight member projects rearwardly and generally at right angles to said lower leading edge of said club head.

20. The golf club head of claim 19 wherein said second weight member projects from said hosel rearwardly and generally at right angles to said lower leading edge.

21. The golf club head of claim 19 wherein said second weight member projects from said hosel away from and generally parallel to said lower leading edge.

22. The golf club head as claimed in claim 20 wherein said second weight member tapers upwardly and outwardly along said hosel.

23. The golf club head as claimed in claim 21 wherein said second weight member tapers upwardly and outwardly along said hosel.

24. The golf club head of claim 22 wherein a rear face of said club head is a recessed cavity back surrounded by a top rim, bottom rim, toe rim and heel rim and said first weight member projects rearwardly from said toe rim such that said first weight member extends rearwardly of a plane containing said top rim, bottom rim, toe rim and heel rim.

25. The golf club head of claim 24 wherein said rear face is a recessed cavity back surrounded by a top rim, bottom rim, toe rim and heel rim and said first weight member projects rearwardly from said toe rim such that said first weight member extends rearwardly of a plane containing said top rim, bottom rim, toe rim and heel rim.

26. The golf club head of claim 25 further comprising a third weight member extending rearwardly from said heel rim.

27. A golf club head having a toe, a heel, a body extending between said toe and said heel, and a hosel extending upwardly from said heel for receiving a golf club shaft, said club head including a center of gravity located between said toe and said heel, and a weight member projecting outwardly from an angular segment of the periphery of said hosel, wherein said angular segment is less than 360°.

28. The golf club head of claim 27 wherein said angular segment is approximately 90° and wherein, at one extreme thereof, said weight member projects away from and generally parallel to a lower leading edge of said club head and, at another extreme thereof, said weight member projects rearwardly and generally at right angles to said lower leading edge of said club head.

29. The golf club head of claim 28 wherein said weight member projects from said hosel rearwardly and generally at right angles to said lower leading edge.

30. The golf club head of claim 28 wherein said weight member projects from said hosel away from and generally parallel to said lower leading edge.

31. The golf club of claim 27 wherein at least a portion of said weight member is positioned above a horizontal line containing the center of gravity, said horizontal line being generally parallel to a support surface on which said club head rests when said club head is lying at address.

32. The golf club of claim 31 wherein said weight member includes a center of mass located above said horizontal line.

33. The golf club head as claimed in claim 27 wherein said weight member tapers upwardly and outwardly along said hosel.

* * * * *

US005335914B1

REEXAMINATION CERTIFICATE (3810th)

United States Patent [19]

Long

[11] B1 5,335,914

[45] Certificate Issued Jul. 13, 1999

[54] GOLF CLUB HEAD

[75] Inventor: Clay Long, Albany, Ga.

[73] Assignee: The Arnold Palmer Golf Company, Ooltewah, Tenn.

Reexamination Request:
No. 90/004,665, Jun. 10, 1997

Reexamination Certificate for:

| | |
|---|---|
| Patent No.: | **5,335,914** |
| Issued: | **Aug. 9, 1994** |
| Appl. No.: | **08/047,262** |
| Filed: | **Apr. 13, 1993** |

[51] Int. Cl.[6] ..... A63B 53/04

[52] U.S. Cl. ..... 473/350; D21/748

[58] Field of Search ..... 473/256, 219, 473/228, 305–315, 324–350, 287–292; D21/220

[56] References Cited

U.S. PATENT DOCUMENTS

| | | |
|---|---|---|
| D. 191,211 | 4/1961 | Forest . |
| D. 240,948 | 8/1976 | Redoutey . |
| D. 247,383 | 2/1978 | Adkins . |
| D. 247,918 | 5/1978 | Delano et al. . |
| D. 254,084 | 1/1980 | Hulyk . |
| D. 259,732 | 6/1981 | Vella . |
| D. 302,715 | 8/1989 | Petersen . |
| D. 316,584 | 4/1991 | Antonious . |
| 1,139,985 | 5/1915 | Legh . |
| 1,258,212 | 3/1918 | Goodrich . |
| 1,525,148 | 2/1925 | Pickop . |
| 1,993,928 | 3/1935 | Glover . |
| 2,608,409 | 8/1952 | Pinkerton . |
| 2,686,056 | 8/1954 | Oquist . |
| 3,059,926 | 10/1962 | Johnstone . |
| 3,064,980 | 11/1962 | Steiner . |
| 3,429,576 | 2/1969 | Ikeda . |
| 3,497,220 | 2/1970 | Scott . |
| 3,625,513 | 12/1971 | Ballmer . |
| 3,941,390 | 3/1976 | Hussey . |
| 3,955,820 | 5/1976 | Cochran et al. . |
| 3,966,210 | 6/1976 | Rozmus . |
| 3,995,857 | 12/1976 | Cochran et al. . |
| 3,995,865 | 12/1976 | Cochran et al. . |
| 4,214,754 | 7/1980 | Zebelean . |
| 4,220,336 | 9/1980 | Kochevar . |
| 4,265,451 | 5/1981 | Bernhardt . |
| 4,265,452 | 5/1981 | Vella . |
| 4,580,784 | 4/1986 | Brill . |
| 4,607,846 | 8/1986 | Perkins . |

(List continued on next page.)

FOREIGN PATENT DOCUMENTS

| | | |
|---|---|---|
| 558183 | 1/1975 | Switzerland . |
| 29603 | of 1913 | United Kingdom . |
| 359487 | 10/1931 | United Kingdom . |
| 1078412 | 8/1967 | United Kingdom . |
| 1232651 | 5/1971 | United Kingdom . |
| 1297239 | 1/1972 | United Kingdom . |
| 2133295 | 7/1984 | United Kingdom . |
| 2170719 | 8/1986 | United Kingdom . |

*Primary Examiner*—Steven B. Wong

[57] ABSTRACT

A golf club having weight members located at the toe and the hosel of a cavity back club head. The toe weight and hosel weight each have a center of mass which is located above a horizontal line drawn through the center of gravity of the club head when the club head is lying at address. In one preferred embodiment the toe weight extends rearwardly from the toe rim of the club head and rearward of a plane containing the rear edges of the club head to increase the back weighting and therefore the dynamic loft of the club head. The hosel weight extends outwardly from the hosel and is located anywhere within a 90° segment of the outer periphery of the hosel. At one extreme position, the hosel weight extends outwardly in a plane which is generally parallel to the leading edge of the club head and at another extreme position the hosel weight extends rearwardly and generally at right angles to the leading edge of the club head.

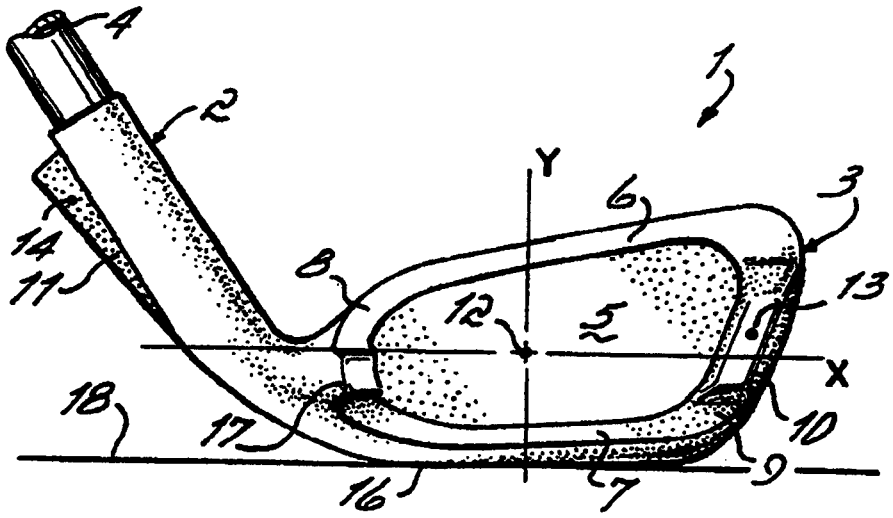

U.S. PATENT DOCUMENTS 4,621,813 11/1986 Solheim .
4,650,191 3/1987 Mills .
4,747,599 5/1988 Antonious .
4,754,977 7/1988 Sahm .
4,826,172 5/1989 Antonious .
4,852,879 8/1989 Collins .
4,867,458 9/1989 Sumikawa et al. .
4,915,386 4/1990 Antonious .
4,938,470 7/1990 Antonious .
4,948,140 8/1990 Antonious .
5,004,237 4/1991 Antonious .
5,011,151 4/1991 Antonious .
5,046,733 9/1991 Antonious .
5,078,400 1/1992 Desbiolles et al. .
5,165,688 11/1992 Schmidt et al. .

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 4, lines 26–29:

FIG. 5 is a rear elevational view showing the club head at address resting on a support surface but showing the hosel weight in one alternative position extending outwardly from a rear portion of the hosel *opposite the front portion of the hosel*;

Column 5, lines 30–42:

As further shown in FIG. 2, the hosel weight 11 tapers in thickness such that its thickness in a plane perpendicular to the hosel 2 increases upwardly along the hosel 2. *Additionally, the hosel weight 11 is shown tapering upwardly and outwardly along the hosel 2 at a first angle relative to the hosel 2 then tapering upwardly and inwardly along the hosel 2 at a second angle relative to the hosel 2, the second angle being greater than the first angle.* This concentrates the added weight in an upper portion of the hosel 2 so as to further increase the moment of inertia of the club head 1 about the horizontal axis "x". Also, when the hosel weight 11 is used in the alternative location (shown in FIG. 4) in which it extends rearwardly generally at right angles to the lower leading edge 15 of the club head 1, the tapered shape and rearward position tend to reduce the aerodynamic drag of the club head during the swing resulting in higher club head speed at impact.

AS A RESULT OF REEXAMINATION, IT HAS BEEN DETERMINED THAT:

The patentability of claims 1–26 and 28–30 is confirmed.

Claims 27, 31, 32 and 33 are cancelled.

New claims 34–47 are added and determined to be patentable.

*34. A golf club head having a toe, a heel, a body extending between said toe and said heel, and a hosel extending upwardly from said heel for receiving a golf club shaft, said club head including a center of gravity located between said toe and said heel, and a weight member projecting outwardly from an angular segment of the periphery of said hosel, wherein said angular segment is approximately 90°, and wherein said weight member tapers upwardly and outwardly along said hosel, and wherein, at one extreme thereof, said weight member projects away from and generally parallel to a lower leading edge of said club head and, at another extreme thereof, said weight member projects rearwardly and generally at right angles to said lower leading edge of said club head.*

*35. The golf club head of claim 34 wherein said weight member projects from said hosel rearwardly and generally at right angles to said lower leading edge.*

*36. The golf club head of claim 34 wherein said weight member projects from said hosel away from and generally parallel to said lower leading edge.*

*37. A golf club head having a toe, a heel, a body extending between said toe and said heel, and a hosel extending upwardly from said heel for receiving a golf club shaft, said club head including a center of gravity located between said toe and said heel, and a weight member projecting outwardly from an angular segment of the periphery of said hosel, wherein said angular segment is less than 360°, and wherein said weight member tapers upwardly and outwardly along said hosel at a first angle relative to said hosel then tapers upwardly and inwardly along said hosel at a second angle relative to said hosel, said second angle being greater than said first angle.*

*38. A golf club head having a toe, a heel, a body extending between said toe and said heel, and a hosel extending upwardly from said heel for receiving a golf club shaft, said club head including a center of gravity located between said toe and said heel, and a weight member projecting outwardly from an angular segment of the periphery of said hosel other than from a front portion of said hosel, wherein said angular segment is approximately 90°, and wherein, at one extreme thereof, said weight member projects away from and generally parallel to a lower leading edge of said club head and, at another extreme thereof, said weight member projects rearwardly and generally at right angles to said lower leading edge of said club head.*

*39. The golf club head of claim 38 wherein said weight member projects from said hosel rearwardly and generally at right angles to said lower leading edge.*

*40. The golf club head of claim 38 wherein said weight member projects from said hosel away from and generally parallel to said lower leading edge.*

*41. A golf club head having a toe, a heel, a body extending between said toe and said heel, and a hosel extending upwardly from said heel for receiving a golf club shaft, said club head including a center of gravity located between said toe and said heel, and a weight member projecting outwardly from an angular segment of the periphery of said hosel other than from a front portion of said hosel, wherein said angular segment is less than 360° and wherein said weight member tapers upwardly and outwardly along said hosel at a first angle relative to said hosel then tapers upwardly and inwardly along said hosel at a second angle relative to said hosel, said second angle being greater than said first angle.*

*42. A golf club head having a toe, a heel, a body extending between said toe and said heel, and a hosel extending upwardly from said heel for receiving a golf club shaft, said club head including a center of gravity located between said toe and said heel, and a weight member projecting outwardly from an angular segment of the periphery of said hosel, wherein said angular segment is less than 360°, and wherein said weight member projects from said hosel away from and generally parallel to a lower leading edge of said club head, and wherein said weight member tapers upwardly and outwardly along said hosel at a first angle relative to said hosel then tapers upwardly and inwardly along said hosel at a second angle relative to said hosel, said second angle being greater than said first angle.*

*43. A golf club head having a toe, a heel, a body extending between said toe and said heel, and a hosel extending upwardly from said heel for receiving a golf club shaft, said club head including a center of gravity located between said toe and said heel, and a weight member projecting outwardly from an angular segment of the periphery of said hosel, and wherein said angular segment is less than 360°, said weight member significantly backweighting the club head.*

*44. The golf club head of claim 43 wherein at least a portion of said weight member is positioned above a horizontal line containing the center of gravity, said horizontal line being generally parallel to a support surface on which said club head rests when said club head is lying at address.*

*45. The golf club head of claim 44 wherein said weight member includes a center of mass located above said horizontal line.*

*46. The golf club head of claim 43 wherein said weight member tapers upwardly and outwardly along said hosel.*

*47. The golf club head of claim 43 wherein said weight member tapers upwardly and outwardly along said hosel at a first angle relative to said hosel then tapers upwardly and inwardly along said hosel at a second angle relative to said hosel, said second angle being greater than said first angle.*

* * * * *